US006992555B2

(12) United States Patent
Hasegawa et al.

(10) Patent No.: US 6,992,555 B2
(45) Date of Patent: Jan. 31, 2006

(54) GAPPED AMORPHOUS METAL-BASED MAGNETIC CORE

(75) Inventors: Ryusuke Hasegawa, Morristown, NJ (US); Ronald J. Martis, East Hanover, NJ (US)

(73) Assignee: Metglas, Inc., Conway, SC (US)

( * ) Notice: Subject to any disclaimer, the term of this patent is extended or adjusted under 35 U.S.C. 154(b) by 0 days.

(21) Appl. No.: 10/354,711

(22) Filed: Jan. 30, 2003

(65) Prior Publication Data

US 2004/0150503 A1 Aug. 5, 2004

(51) Int. Cl.
*H01F 17/06* (2006.01)

(52) U.S. Cl. ..... 336/178; 336/234

(58) Field of Classification Search ..... 336/221, 336/178, 229, 213, 233–4; 148/108, 304, 148/403

See application file for complete search history.

(56) References Cited

U.S. PATENT DOCUMENTS 4,587,507 A * 5/1986 Takayama et al. ..... 336/178
4,637,843 A * 1/1987 Takayama et al. ..... 420/73
6,144,279 A * 11/2000 Collins et al. ..... 336/178
6,480,008 B2 * 11/2002 Okamoto et al. ..... 324/662
6,563,411 B1 * 5/2003 Otte et al. ..... 336/60

OTHER PUBLICATIONS

PCT Written Opinion, Mar. 17, 2005.

* cited by examiner

*Primary Examiner*—Tuyen T Nguyen
(74) *Attorney, Agent, or Firm*—Staas & Halsey LLP

(57) ABSTRACT

A magnetic implement has a gap size ranging from about 1 to about 20 mm. The implement comprises a magnetic core composed of an amorphous Fe-based alloy. A physical gap is disposed in the core's magnetic path. The alloy has an amorphous structure; is based on the components: (Fe—Ni—Co)—(B—Si—C). The sum of its Fe+Ni+Co content is in the range of 65–85 atom percent. Advantageously, the core exhibits an overall magnetic permeability ranging from about 40 to about 200 and enhanced magnetic performance.

10 Claims, 7 Drawing Sheets

GAPPED AMORPHOUS METAL-BASED MAGNETIC CORE

BACKGROUND OF THE INVENTION

1. Field of the Invention

This invention relates to magnetic cores; and more particularly to a ferromagnetic amorphous metal alloy core having a gap in its magnetic path and especially suited for use in electrical chokes and current sensors.

2. Description of the Prior Art

An electrical choke and an electric current sensor having a magnetic core require a low magnetic permeability to control or sense a large electrical current. Generally, a magnetic core with a low permeability does not magnetically saturate until it is driven to a large magnetic field. The upper limit of the field is determined by the saturation induction or flux density, commonly called $B_s$ of the core material. Since the quantity $B_s$ depends on the chemistry of the core material, choice of the core material depends on the application. The permeability $\mu$, defined as an incremental increase in the magnetic flux B with an incremental increase in the applied field H, is preferably linear in these applications because a core's magnetic performance becomes relatively stable with increasing applied field strength. When the permeability is linear, the upper magnetic field, $H_p$, which is proportional to the current in the copper winding on the core, is approximately given by $B_s/\mu$. Thus when a larger $H_p$ is desired, a lower value of $\mu$ is preferred. The linear BH behavior is also preferred because the total core loss can be reduced considerably. For an electrical choke, a reasonable linearity in the core's BH characteristics is needed and a moderate level of curvature in the BH curves is acceptable. However, for a current sensor application, a good linear BH characteristic is required to assure the sensor's accuracy.

One of the best techniques to achieve a good BH linearity is to utilize the magnetization behavior along the magnetically hard axis of a magnetic material with an uniaxial magnetic anisotropy. Magnetic anisotropy is a measure of the degree of aligning the magnetization in a magnetic material. In the absence of an external magnetic field, the magnetic anisotropy forces the magnetization in a magnetic material along its so-called magnetic easy axis, which is energetically in the lowest state. For a crystalline material, the direction of the magnetic anisotropy or easy axis is often along one of the crystallographic axes. By way of example, the easy axis for iron, which has a body-centered-cubic structure, is along the [001] direction. When this kind of uniaxial magnetic material is magnetized along the easy axis, the resultant BH behavior is rectangular; the material exhibits a coercivity $H_c$, defined as the field at which the induction or flux B intersects the field or H axis. Above $H=H_c$, the magnetic material quickly saturates with the applied field, reaching $B=B_s$, the saturation induction or flux density. When the external field is along the direction 90 degrees away from the easy axis, the responding flux density B varies linearly with H competing with the magnetic anisotropy field $H_k$ defined as $8\ \pi K/B_s$ where K is the magnetic anisotropy energy. Thus in principle, at $H=H_k$, B becomes $B_s$.

Magnetic anisotropy can be induced by post material-fabrication treatments such as magnetic field annealing at elevated temperature. When a magnetic material is heated, the constituent magnetic atoms become thermally activated and tend to align along the magnetic field applied, resulting in a magnetic anisotropy discussed above. This is one technique often used to induce a linear BH behavior in a magnetic material, including amorphous magnetic materials. Another technique is to introduce a physical gap in the magnetic path of a magnetic implement. When this method is employed, over-all BH behavior tends to become linear. However, the linearity accompanies increased magnetic losses due to magnetic flux leakage in the gap. It is thus desirable to minimize the gap size as much as possible. In addition, the gap has to be introduced with a minimal increase of the magnetic losses due to stress or mechanical deformation introduced during gapping.

An effort to introduce physical gaps in toroidally shaped magnetic implements made of amorphous material was outlined in the U.S. Pat. No. 4,587,507 issued to Takayama et al (the '507 Patent). This patent addresses only the consideration that involves reducing the effects of stress introduced during gapping. The '507 Patent claims that the amorphous magnetic alloys consist essentially of the composition: $Fe_xMn_y(Si_pB_qP_rC_s)_z$, wherein x+y+z (in atom percent) is 100, y ranges from 0.001 to 10, z ranges from 21 to 25.5, p+q+r+s=1, p ranges from 0.40 to 0.75, r ranges from 0.0001 to 0.05, the ratio s/q ranges from 0.03 to 0.4 and z is $z \leqq 50\ p+1$, $z \leqq 10\ p+19$, $z \geqq 30\ p+2$ and $z \geqq 13\ p+13.7$. The '507 patent claims require that Mn must be present to achieve the envisaged magnetic loss reduction after gapping.

Clearly needed is a technique for fabrication of magnetic implements that is free of the compositional constraints required by the '507 Patent. Also needed is a more complete understanding of the gap size, which affects the magnetic loss and hence the over-all magnetic performance of a magnetic implement. This feature must be clearly controlled when producing a magnetic implement having high performance. The present invention provides solutions to each of the aforesaid problems, including the effects of stress introduced in a core-gapping process.

SUMMARY OF THE INVENTION

The present invention provides a magnetic implement and method for fabrication thereof that avoids the compositional constraints discussed hereinabove. Gap sizes for implements fabricated in accordance with the invention are readily obtained within a range of about 1 to about 20 mm. Advantageously, the over-all magnetic performance of the magnetic implement is enhanced. The implement comprises a magnetic core composed of an amorphous Fe-based alloy having a physical gap in it magnetic path. In a preferred embodiment, the alloy has an amorphous structure; is based on the components: (Fe—Ni—Co)—(B—Si—C), the sum of its Fe+Ni+Co content being in the range of 65–85 at.%.

Generally stated, in practice of the fabrication technique, a magnetic Fe-based amorphous-alloy ribbon is wound into a toroidally shaped core. The wound core is then heat-treated without an external field. For cores requiring low magnetic loss after gapping, the heat-treatment is designed so that the un-gapped cores exhibits as low a permeability as possible. Cores requiring substantially linear BH behaviors after gapping are heat-treated so that the BH curves are as square as possible, or as sheared as possible. The annealed cores are then coated with a commercially available epoxy resin, such as Dupont EFB534SO, or the like, prior to gapping. A gapping process is selected which introduces as little stress or mechanical deformation as possible following gap formation. Such a process can comprise water-jet cutting, as well as abrasive and electro-discharge cutting. The size of the physical gap is predetermined; based on the permeability of the ungapped core and the desired permeability of the core in the gapped state. Upon being gapped, the core is coated with a thin layer of resin, paint or the like. Such a coating protects the surface of the gap against rust. Alternatively, protection of the core is accomplished by housing it within a plastic box. When copper windings were placed on the cores of the present invention, the core-coil assembly achieves the level of performance needed for current sensors and electrical chokes, including power factor correction inductors.

BRIEF DESCRIPTION OF THE DRAWINGS

The invention will be more flilly understood and further advantages will become apparent when reference is made to the following detailed description of the preferred embodiments of the invention and the accompanying drawings, in which.

DETAILED DESCRIPTION OF THE INVENTION

A number of toroidally shaped magnetic cores are tape-wound from Fe-based amorphous alloy ribbons including commercially available METGLAS®2605SA1 and 2605CO materials. The physical dimensions of the cores are: OD (outside diameter)=8-70 mm; ID (inside diameter)=5-40 mm and HT (height)=5-25 mm. These cores are heat-treated between 300 and 450° C. for 1–12 hours with or without magnetic fields applied on the cores. The choice of the annealing parameters depends on the desired final magnetic performances of the gapped cores fabricated in the following manner. These cores are impregnated with epoxy resin comprised of Dupont EFB534SO. The coated cores are then cut to introduce physical gaps in the toroids' magnetic paths. The size of the physical gap is varied between about 1 mm and about 20 mm. The gapping tools include water-jet, as well as abrasive and electro-discharge cutting machines. The cut surfaces are then coated with resins or paints to protect them from rusting.

Figure 1:
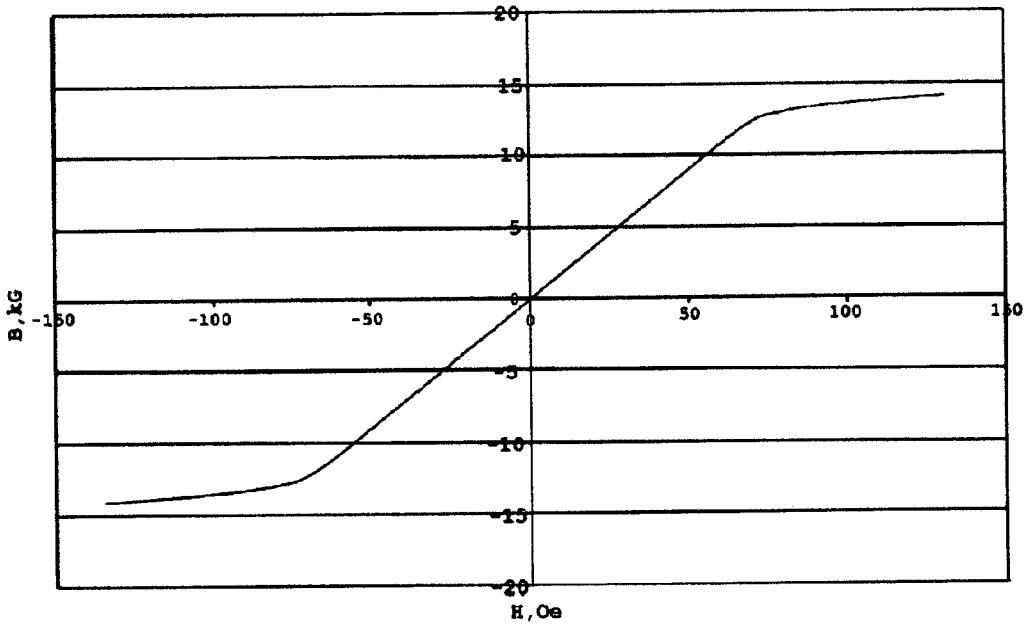
FIG. 1 is a graph showing the BH behavior of a core containing a physical gap size of about 3.2 mm, the core being based on Fe-based METGLAS®2605SA1 material annealed at 350° C. for 2 hours in the presence of a magnetic field of about 10 Oe applied along the core's circumference direction.
Figure 2:
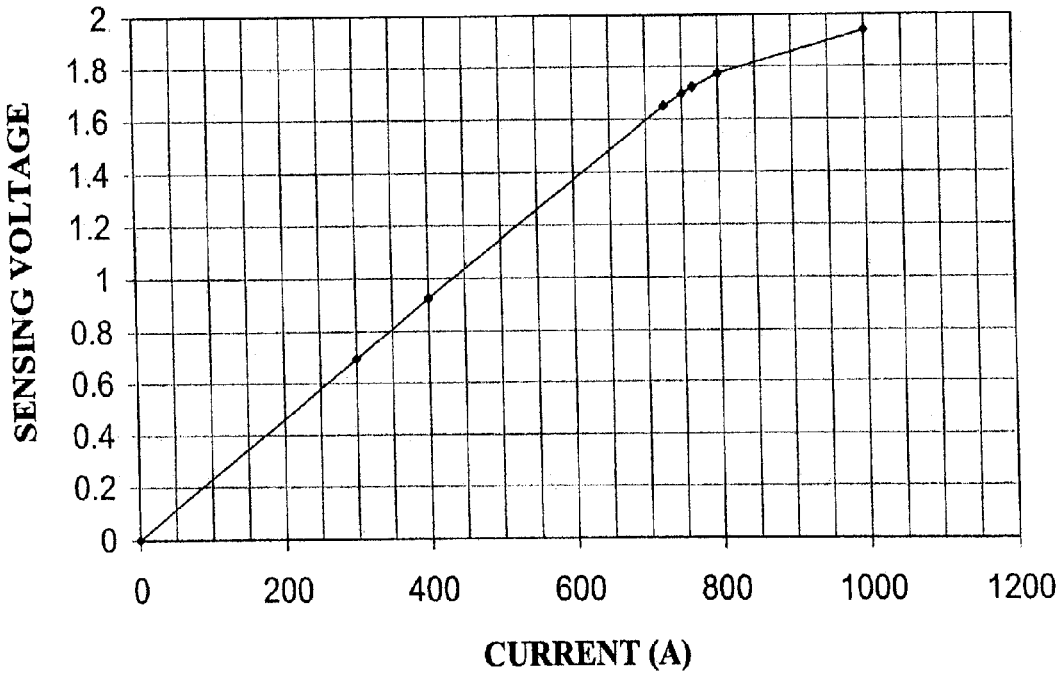
FIG. 2 is a graph showing the sensing voltage as a function of the current to be probed for the core of FIG. 1.
Figure 3:
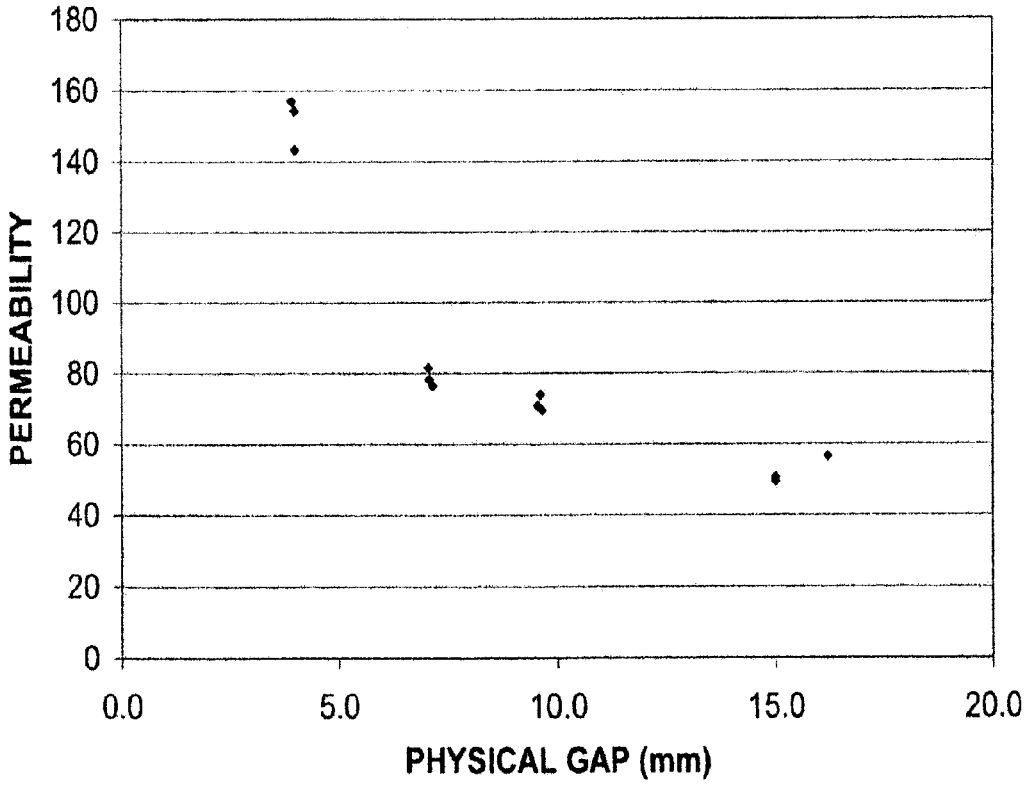
FIG. 3 is a graph showing permeability as a function of physical gap for METGLAS ®2605SA1-based cores.

For applications such as those involved in current sensing, a linear BH behavior is required of the core. In this case, ungapped cores must have a BH curve as square as possible or as sheared as possible with as little curvature in the BH curve as possible so that the BH curve becomes as linear as possible after gapping. To achieve a square BH curve in an ungapped core, a longitudinal magnetic field is, optionally, applied during the heat-treatment of the core. A sheared BH loop is achieved by application of a transverse field along the direction of the core axis. The transverse field strength ranges up to about 1,500 Oe. A number of cores are prepared by tape-winding METGLAS®2605SA1 or 2605CO ribbon annealed at 320° C.-380° C. for about 2 hours with or without applied fields. The resulting cores exhibit relatively square BH behaviors. Physical gaps ranging from about 1 to 20 mm are formed in the cores. A BH curve for one of the gapped cores, shown in FIG. 1, exhibits a linear DC permeability $\mu_{dc}$ of about 180 up to about H~70 Oe (0.88 A/m). This upper field limit may be termed $H_p$, as defined hereinabove. The same core is used to fabricate a current sensor having a single turn current-carrying wire inside the ID section of the core. A sensing coil is wound on the core and the signal voltage is monitored with a digital voltmeter. The sensing voltage is shown in FIG. 2 as a function of the current in the single turn current-carrying wire inserted in the hole of the core-coil sensor. A good linear relationship between the sensing signal and the current is clearly shown to result from the BH behavior of FIG. 1. The permeability is further reduced by increasing the physical gap, which is shown in FIG. 3. Decreased permeability makes it possible to increase the upper limit for the current to be sensed. For example, a permeability of 50 achieved for a physical gap of about 15 mm increases the upper field limit to about 240 Oe (3 A/m), up to which limit, the core's BH behavior is kept linear. This, in turn, increases the upper current limit of a single-turn current sensor to above 2700 A level.

Figure 7:
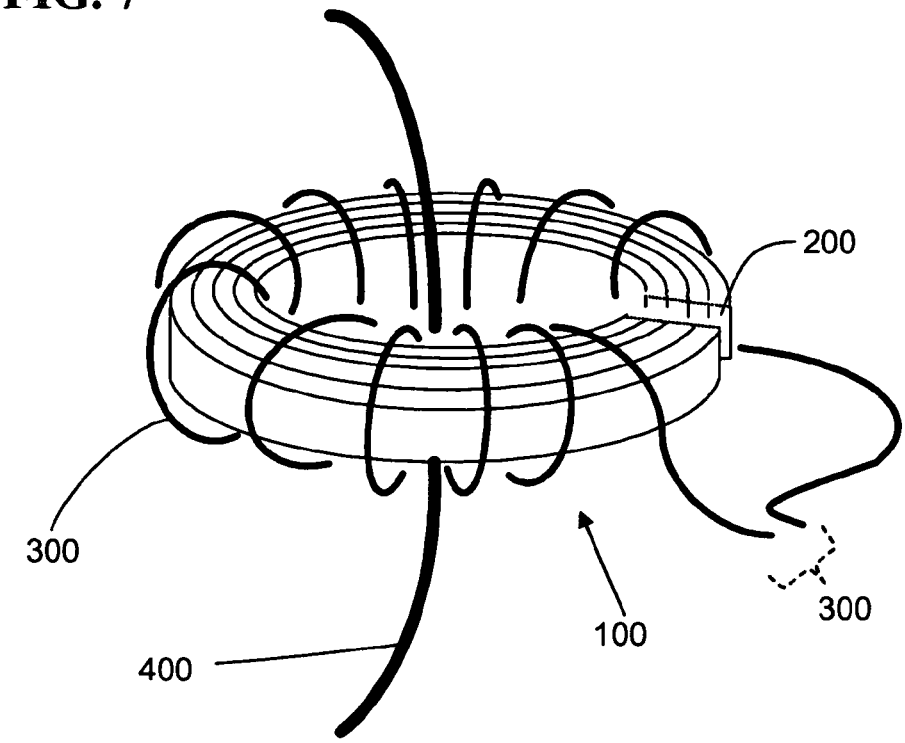
FIG. 7 is a perspective, schematic view of a magnetic implement of the invention suited for use as a current sensor.

Referring now to FIG. 7, there is depicted a magnetic implement 100 suited for use as a current sensor. The implement includes a toroidal core wound using amorphous metal strip. A physical gap 200 is cut in the core. A plurality of windings 300 encircle the toroid and a single wire 400 is threaded through the center of the core.

For applications such as electrical chokes, low magnetic permeabilities are required of the cores. The purpose of gapping is to reduce the magnetic permeability of a core. This, however, increases the magnetic losses due to magnetic flux leaking at the gap. Thus a smaller physical-gap size is preferred. This self-conflicting effect can be minimized by starting with as low permeability as possible in the ungapped state. The annealing parameters mentioned above are optimized accordingly. For an ungapped core made from commercially available METGLAS®2605SA1 ribbon, the annealing temperature is between 410° C. and 450° C., and the annealing time between 3 and 12 hours. After gapping, these cores show permeabilities ranging from about 20 to 140.

Figure 4:
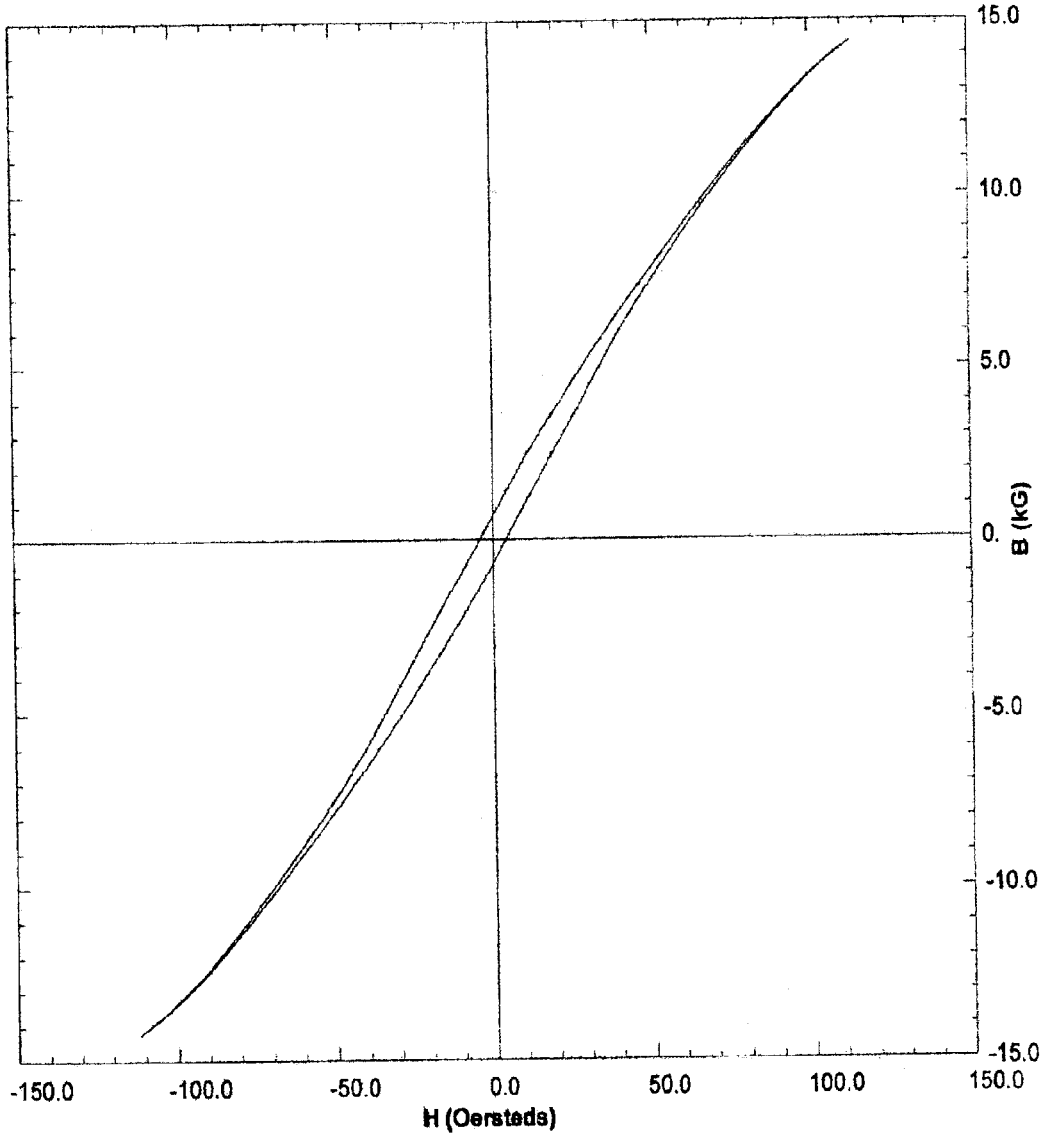
FIG. 4 is a graph showing the BH behavior of a core containing a physical gap size of about 3 mm, the core being based on Fe-based METGLAS ®2605SA1 ribbon annealed at 430° C. for 7 hours with no field.
Figure 5:
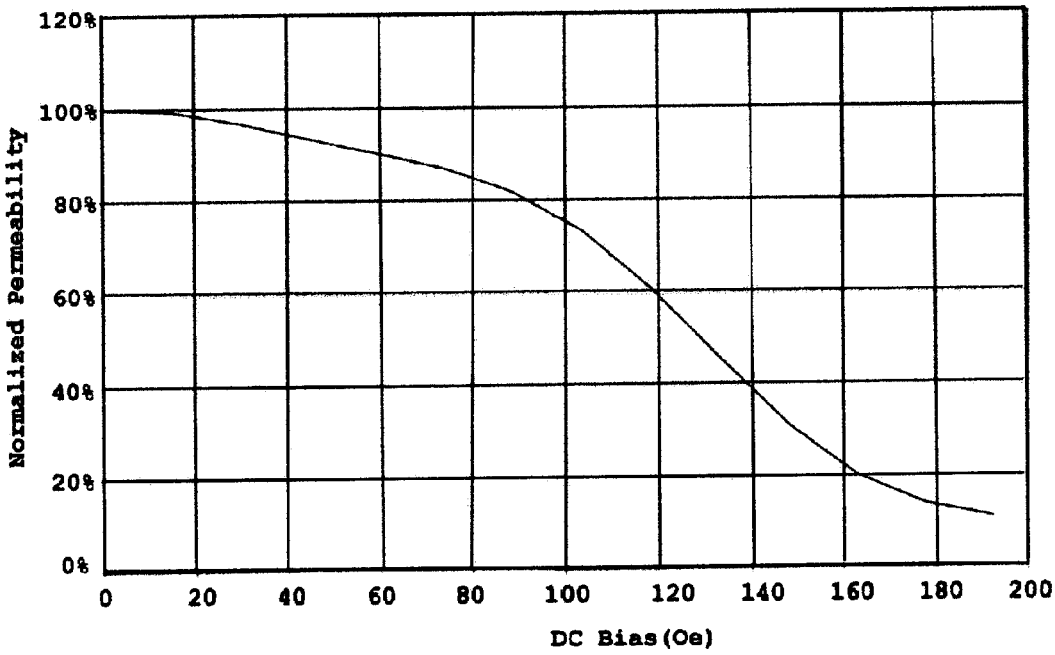
FIG. 5 is a graph showing the permeability value relative to the value at zero applied-field as a function of DC bias field for the core of FIG. 4.
Figure 6:
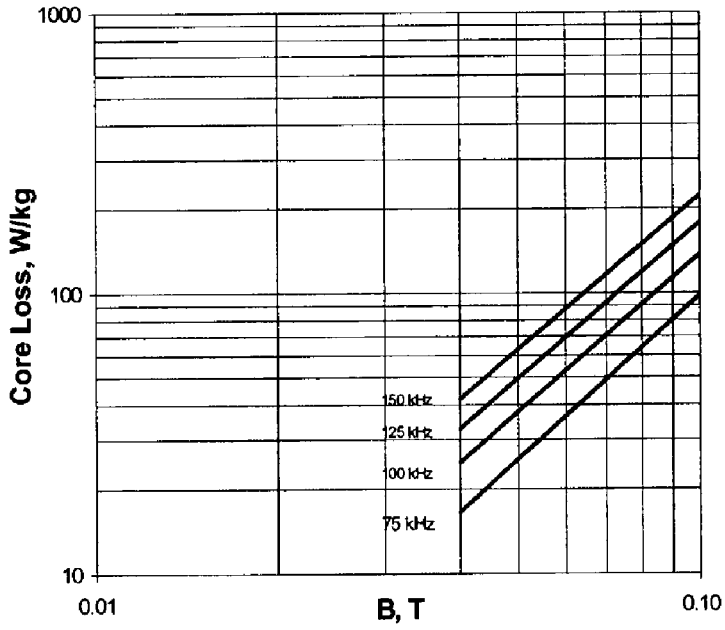
FIG. 6 is a graph showing the core loss at different frequencies as a function of induction level, B.

FIG. 4 depicts one such example with a gap of about 3 mm. The core's OD, ID and HT are about 34, 22 and 11 mm, respectively. Physical gap size is changed to optimize the magnetic performances of a core with a given set of OD, ID, and HT. The result of one such example is depicted in FIG. 5, which shows the permeability relative to that at zero applied field as a function of DC bias field for the core of FIG. 4, indicating that this core is magnetically effective up to a field exceeding 100 Oe (1.25 A/m). A similar core without a physical gap is only effective up to about 10 Oe (0.125 A/m). The core loss at different frequencies is shown in FIG. 6 as a function of exciting induction or flux density level, B. For example, at 100 kHz and at the induction level of 0.1 T, core loss of about 140 W/kg is observed. In Table II below the performance of the cores of the present invention is compared with that of commercially available cores.

The features set forth in Table II indicate that the gapped cores of the present invention, when used as electrical chokes, exhibit improved performance. This makes the gapped cores of the present invention especially well suited for use in power factor correction inductors that handle large currents.

Figure 8:
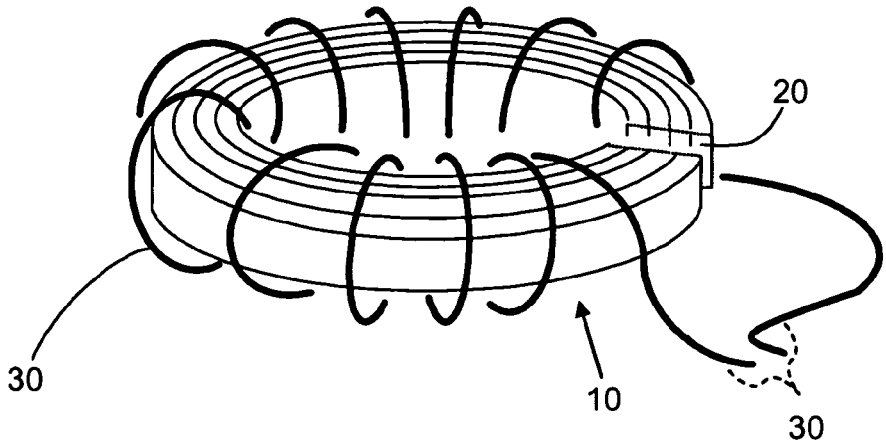
FIG. 8 is a perspective, schematic view of a magnetic implement of the invention suited for use as an electrical choke or power factor correction inductor.

FIG. 8 depicts a magnetic implement a magnetic implement 10 suited for use as an electrical choke or power factor correction inductor. The implement includes a toroidal core wound using amorphous metal strip. A physical gap 20 is cut in the core. A plurality of windings 30 encircle the toroid.

TABLE II

| Core Type | Permeability at 10 kHz | % Permeability at 50 Oe bias | % Permeability at 100 Oe bias | Core Loss (W/kg) at 100 kHz/0.1 T |
|---|---|---|---|---|
| Present Invention | 100 | 90 | 75 | 140 |
| Sendust | 60 | 74 | 46 | 140 |
| Iron Powder | 35 | 94 | 78 | 540 |

The following examples are presented to provide a more complete understanding of the invention. The specific techniques, conditions, materials, proportions and reported data set forth to illustrate the principles and practice of the invention are exemplary and should not be construed as limiting the scope of the invention.

EXAMPLES

Magnetic Characterization

Toroidally shaped cores are tested prior to and after gapping, using a commercially available BH loop tracer under DC excitation. FIG. 1 and FIG. 4 are representative BH curves taken on the cores. For this measurement, primary and a secondary windings of 20 turns each were placed on the cores. The primary coil magnetically excites a core with an applied field H, and the secondary coil measures its magnetic response relating to the resultant induction B. The DC permeability $\mu_{dc}$ is the slope of B versus H. The same cores with windings are used to characterize their high frequency properties employing a commercially available inductance bridge and core loss measurement device following IEEE Standards 393-1991 "IEEE Standard for Test Procedures for Magnetic Cores". FIGS. 3, 5 and 6 were thus obtained.

Electrical Characterization

For current sensing, a single turn carrying a current to be probed is inserted in the central hole of a toroidally shaped core of FIG. 1 and a five-turn coil is placed on the core to measure the sensing voltage, which is proportional to the current. The sensing voltage is a commercially available digital voltmeter. FIG. 2 is thus obtained.

Having thus described the invention in rather full detail, it will be understood that such detail need not be strictly adhered to but that various changes and modifications may suggest themselves to one skilled in the art, all falling within the scope of the present invention as defined by the subjoined claims.

What is claimed is:

1. A magnetic implement, comprising a magnetic core based on an amorphous Fe-based alloy ribbon wound into a toroidally shaped core, said core being epoxy-impregnated and having a cut air gap in its magnetic path, said core exhibiting an overall magnetic permeability ranging from about 40 to about 200, wherein said amorphous Fe-based alloy is based on (Fe—Ni—Co)—(B—Si—C), the sum of the (Fe+Ni+Co) content ranging from 65 to 85 atom %.

2. A magnetic implement as recited by claim 1, wherein said physical gap ranges from about 1 to about 20 mm.

3. A magnetic implement as recited by claim 1, having more than one copper winding operative to form a magnetic core-coil assembly.

4. A magnetic implement as recited by claim 3, wherein said magnetic core-coil assembly is a current sensor.

5. A magnetic implement as recited by claim 3, wherein said core-coil assembly as is an electrical choke.

6. A magnetic implement as recited by claim 3, wherein said core-coil assembly is a power factor correction inductor.

7. A magnetic implement as recited by claim 1, said core having been heat-treated in the presence of a magnetic field prior to introduction of said physical gap.

8. A magnetic implement as recited by claim 7, wherein said magnetic field is a longitudinal magnetic field applied along the length direction of the ribbon wound in a toroidal form.

9. A magnetic implement as recited by claim 7, wherein said magnetic field is a transverse magnetic field applied along the width direction of the ribbon wound in a toroidal form.

10. A magnetic implement, comprising a magnetic core based on an amorphous Fe-based alloy ribbon wound into a toroidally shaped core, said core having been heat treated in the presence of a magnetic field and having a physical gap in its magnetic path, said core exhibiting an overall magnetic permeability ranging from about 40 to about 200, wherein said amorohous Fe-based alloy is based on (Fe—Ni—Co)—(B—Si—C), the sum of the (Fe+Ni+Co) content ranging from 65 to 85 atom %.

* * * * *

UNITED STATES PATENT AND TRADEMARK OFFICE

CERTIFICATE OF CORRECTION

PATENT NO. : 6,992,555 B2
APPLICATION NO. : 10/354711
DATED : January 31, 2006
INVENTOR(S) : Ryusuke Hasegawa et al.

It is certified that error appears in the above-identified patent and that said Letters Patent is hereby corrected as shown below:

Column 6, Line 29 (claim 5, line 2), delete “as”.
Column 6, Line 49 (claim 10, line 7), delete “amorohous” and insert -- amorphous -- therefor.

Signed and Sealed this

Twelfth Day of December, 2006

JON W. DUDAS
*Director of the United States Patent and Trademark Office*